US010384103B1

(12) United States Patent
Yoon

(10) Patent No.: US 10,384,103 B1
(45) Date of Patent: Aug. 20, 2019

(54) GOLF PUTTER WITH THREE BALL STRIKING PLATES

(71) Applicant: Kichang Yoon, Geneva, IL (US)

(72) Inventor: Kichang Yoon, Geneva, IL (US)

( * ) Notice: Subject to any disclaimer, the term of this patent is extended or adjusted under 35 U.S.C. 154(b) by 0 days.

(21) Appl. No.: 16/045,720

(22) Filed: Jul. 25, 2018

Related U.S. Application Data

(60) Provisional application No. 62/543,331, filed on Aug. 9, 2017.

(51) Int. Cl.

| | |
|---|---|
| ***A63B 53/04*** | (2015.01) |
| ***A63B 53/06*** | (2015.01) |
| ***A63B 53/00*** | (2015.01) |
| *A63B 53/02* | (2015.01) |

(52) U.S. Cl.
CPC ..... *A63B 53/0487* (2013.01); *A63B 53/007* (2013.01); *A63B 53/065* (2013.01); *A63B 53/02* (2013.01); *A63B 2053/023* (2013.01)

(58) Field of Classification Search
USPC ..... 473/324–350
See application file for complete search history.

(56) References Cited

U.S. PATENT DOCUMENTS

D137,283 S * 2/1944 Jakosky ..... 473/306
3,042,405 A * 7/1962 Solheim ..... A63B 53/007 473/313
D193,897 S * 10/1962 Vachon ..... 473/325
D206,540 S * 12/1966 Mackenzie ..... 473/243
D229,208 S * 11/1973 Phinny ..... D21/738
3,770,279 A * 11/1973 Phinny ..... A63B 53/0487 473/313
D231,373 S * 4/1974 Pavelle ..... 473/325
3,981,507 A * 9/1976 Nunziato ..... A63B 53/0487 473/327

(Continued)

FOREIGN PATENT DOCUMENTS

GB 2234680 A * 2/1991 ..... A63B 53/04
GB 2407779 A * 5/2005 ..... A63B 53/0487

(Continued)

*Primary Examiner* — Alvin A Hunter
(74) *Attorney, Agent, or Firm* — Steven Ivy P.C.

(57) ABSTRACT

Disclosed is a putter assembly. When fully assembled, the putter allows an individual using said putter (the "player") to strike a golf ball with either one of the three available striking surfaces. Said choice of striking surfaces allows the player to utilize the front load putting method, and in alternative, the left or the right handed side putting method. The putter assembly comprises of three primary components: 1) U-shaped striking plate, incorporating the left, right and the front striking plate, wherein each of said striking plates further comprises of an impact area; 2) the frame, comprising of the back connecting member, with a disc for stacking weight plates, and the front connecting member, with a hosel for attaching thereto a shaft; 3) and the shaft, allowing the player to manipulate the movement of the putter. The assembly also incorporates putter alignment features, designed to help the player improve his/her shot accuracy. Said features include: 1) lines for visually aligning the impact areas of the striking plates; 2) indicium lines, for identifying the tilt of the shaft, being held by the player.

3 Claims, 9 Drawing Sheets

(56) References Cited

U.S. PATENT DOCUMENTS 4,010,958 A * 3/1977 Long ..... A63B 53/0487 172/371
4,253,667 A * 3/1981 Clark ..... A63B 53/007 473/325
4,290,606 A * 9/1981 Maxwell ..... A63B 53/007 273/129 K
D339,181 S * 9/1993 Grim, Jr. ..... D21/738
5,346,219 A * 9/1994 Pehoski ..... A63B 53/0487 473/325
5,924,938 A * 7/1999 Hines ..... A63B 53/02 473/307
5,976,025 A * 11/1999 Williams ..... A63B 53/0487 473/252
5,993,324 A * 11/1999 Gammil ..... A63B 53/02 473/251
6,394,910 B1 * 5/2002 McCarthy ..... A63B 53/0487 473/251
6,402,638 B1 * 6/2002 Kelley ..... A63B 53/0487 473/256
6,409,613 B1 * 6/2002 Sato ..... A63B 53/0487 473/337
6,634,956 B1 * 10/2003 Pegg ..... A63B 53/007 473/251
6,752,723 B2 * 6/2004 Cullen ..... A63B 53/0487 473/251
6,988,956 B2 * 1/2006 Cover ..... A63B 53/065 473/244
7,077,758 B2 * 7/2006 Rohrer ..... A63B 53/0487 473/251
7,264,557 B1 * 9/2007 Grossbard ..... A63B 53/0487 473/325
D587,325 S * 2/2009 Solheim ..... D21/736
7,578,752 B1 * 8/2009 Flores ..... A63B 53/0487 473/251
D600,761 S * 9/2009 Solheim ..... D21/736
7,674,186 B2 * 3/2010 Bitko ..... A63B 53/0487 473/329
8,109,838 B2 * 2/2012 Solheim ..... A63B 47/02 473/249
D663,797 S * 7/2012 Hopkins ..... D21/736
8,251,836 B2 * 8/2012 Brandt ..... A63B 53/007 473/340
8,597,136 B1 * 12/2013 Grossbard ..... A63B 53/04 473/325
D720,410 S * 12/2014 Brandt ..... D21/736
D720,821 S * 1/2015 Brandt ..... D21/736
2002/0061789 A1 * 5/2002 Yim ..... A63B 69/3685 473/340
2003/0162599 A1 * 8/2003 Klein ..... A63B 53/007 473/251
2003/0228925 A1 * 12/2003 Rohrer ..... A63B 53/0487 473/251
2005/0215346 A1 * 9/2005 Iwade ..... A63B 53/007 473/313
2006/0030420 A1 * 2/2006 Roake ..... A63B 53/065 473/251
2006/0094533 A1 * 5/2006 Warren ..... A63B 53/0487 473/337
2006/0172816 A1 * 8/2006 Johnson ..... A63B 53/0487 473/334
2006/0287130 A1 * 12/2006 Allen ..... A63B 53/0487 473/340
2007/0021237 A1 * 1/2007 Haack ..... A63B 24/0003 473/340
2008/0146369 A1 * 6/2008 Wahl ..... A63B 53/0487 473/334
2008/0167139 A1 * 7/2008 Grossbard ..... A63B 53/0487 473/340
2008/0248892 A1 * 10/2008 Walworth ..... A63B 53/0487 473/303
2008/0300067 A1 * 12/2008 Hamlin ..... A63B 53/0487 473/340
2009/0270196 A1 * 10/2009 Solheim ..... A63B 53/04 473/251
2009/0305807 A1 * 12/2009 Solheim ..... A63B 47/02 473/251
2009/0312117 A1 * 12/2009 Brandt ..... A63B 53/007 473/341
2010/0009781 A1 * 1/2010 Vanderbilt ..... A63B 47/008 473/409
2010/0331105 A1 * 12/2010 Kronogard ..... A63B 53/0487 473/340
2012/0034990 A1 * 2/2012 Cohen ..... A63B 53/0487 473/250
2012/0289362 A1 * 11/2012 Brandt ..... A63B 53/007 473/341
2013/0337932 A1 * 12/2013 Kammerer ..... A63B 53/0487 473/251

FOREIGN PATENT DOCUMENTS

JP 07255886 A * 10/1995
JP 08196667 A * 8/1996
JP 08332249 A * 12/1996
JP 09299522 A * 11/1997
JP 09313654 A * 12/1997
JP 11342232 A * 12/1999
JP 2005211613 A * 8/2005
JP 2006026118 A * 2/2006
JP 2007105422 A * 4/2007
JP 2007209722 A * 8/2007
JP 2008061794 A * 3/2008
JP 2010110616 A * 5/2010 ..... A63B 53/0487
JP 2010201090 A * 9/2010
JP 2010284182 A * 12/2010
JP 2011152427 A * 8/2011
JP 2012045188 A * 3/2012
WO WO-2005102467 A1 * 11/2005 ..... A63B 53/0487
WO WO-2006015420 A1 * 2/2006 ..... A63B 53/0487
WO WO-2008054038 A1 * 5/2008 ..... A63B 53/0487
WO WO-2008082032 A1 * 7/2008 ..... A63B 53/0487

* cited by examiner

GOLF PUTTER WITH THREE BALL STRIKING PLATES

RELATED PATENT APPLICATION

The present Non-Provisional U.S. Patent Application claims the priority from U.S. Provisional Patent Application No. 62/543,331, filed on Aug. 9, 2017, titled Universal, Triple-Faced Golf Putter and a Method of Using Thereof, the subject matter of which is incorporated herein by reference.

FIELD OF THE INVENTION

The present invention addresses the general field of golf equipment, with a specific focus on golf clubs and related accessories.

BACKGROUND OF THE INVENTION

This invention relates to golf clubs, and more particularly to the golf putters configured to enhance their versatility, and improvement of the end-user's performance. To improve the putter's versatility, the present invention introduces a U-shaped striking plate, allowing an individual using the putter to strike a golf ball with either one of the three available striking surfaces. Further improvements include introduction of a weight system, implementing a multitude of replaceable weight plates, providing means of modifying the weight to the putter to accommodate individual requirements. The assembly also incorporates putter alignment features, designed to help the player improve his/her shot accuracy.

SUMMARY OF THE INVENTION

The following is intended to be a brief summary of the invention and is not intended to limit the scope of the invention:

The present invention discloses a putter assembly. When fully assembled, the putter allows an individual using said putter (the "player") to strike a golf ball with either one of the three available striking surfaces. Said choice of striking surfaces allows the player to utilize the front load putting method, and in alternative, the left or the right handed side putting method.

The putter assembly comprises of four primary components: (1) U-shaped striking plate, incorporating the left, right and the front striking plate, wherein each of said striking plates further comprises of an impact area; (2) the frame, comprising of the back connecting member, with a disc for stacking weight plates, and the front connecting member, with a hosel for attaching thereto a shaft; (3) and the shaft, allowing the player to manipulate the movement of the putter; (4) the weight plates, providing means of adding weight to the said fame of the assembly.

The assembly also incorporates putter alignment features, designed to help the player improve his/her shot accuracy. Said features, attached to the striking plate and the frame, include: (1) lines for visually aligning the impact areas of the striking plates; (2) indicium lines, for identifying the tilt of the shaft, being held by the player.

BRIEF DESCRIPTION OF THE DRAWINGS

The components shown in the drawings are not to scale. In the interest of clarity, some of the components might be shown in a generalized form and could be identified utilizing commercial designations. All components, including its essential features, have been assigned reference numbers that are utilized consistently throughout the descriptive process outlined herein.

DESCRIPTIVE KEY

100—putter assembly
- 110—U-shaped striking plate
  - 111—left striking surface
    - 112—impact area, left striking surface
  - 113—right striking surface
    - 114—impact area, right striking surface
  - 115—front striking surface
    - 116—impact area, front striking surface
  - 117—top surface, striking plate
  - 118—internal wall
    - 119—left internal surface
    - 120—right internal surface
    - 121—front internal surface
- 130—frame
  - 131—back connecting member
    - 132—back disk
    - 133—threaded hole, back disc
    - 134—left arm, back connecting member
    - 135—right arm, back connecting member
    - 136—middle arm, back connecting member
  - 137—front connecting member
    - 138—middle arm, front connecting member
    - 135—left disc, front connecting member
    - 136—right disc, front connecting member
  - 137—hosel
    - 138—threaded hole, hosel
  - 140—shaft
    - 141—threaded end, shaft
  - 150—lines for visually aligning impact areas
    - 151—left horizontal line, aligning impact areas
    - 152—right horizontal line, aligning impact areas
    - 153—vertical line, aligning impact areas
  - 160—indicium lines for identifying the tilt of the shaft
    - 161—left indicium lines
    - 162—right indicium lines
  - 170—weight system, or means for adding weight to the frame
    - 171—weight plate
      - 172—clearance hole, weight plate
    - 173—bolt
      - 174—head, bolt
      - 175—threaded end, bolt
  - 200—golf ball

DETAILED DESCRIPTION OF THE PREFERRED EMBODIMENT

Figure 1:
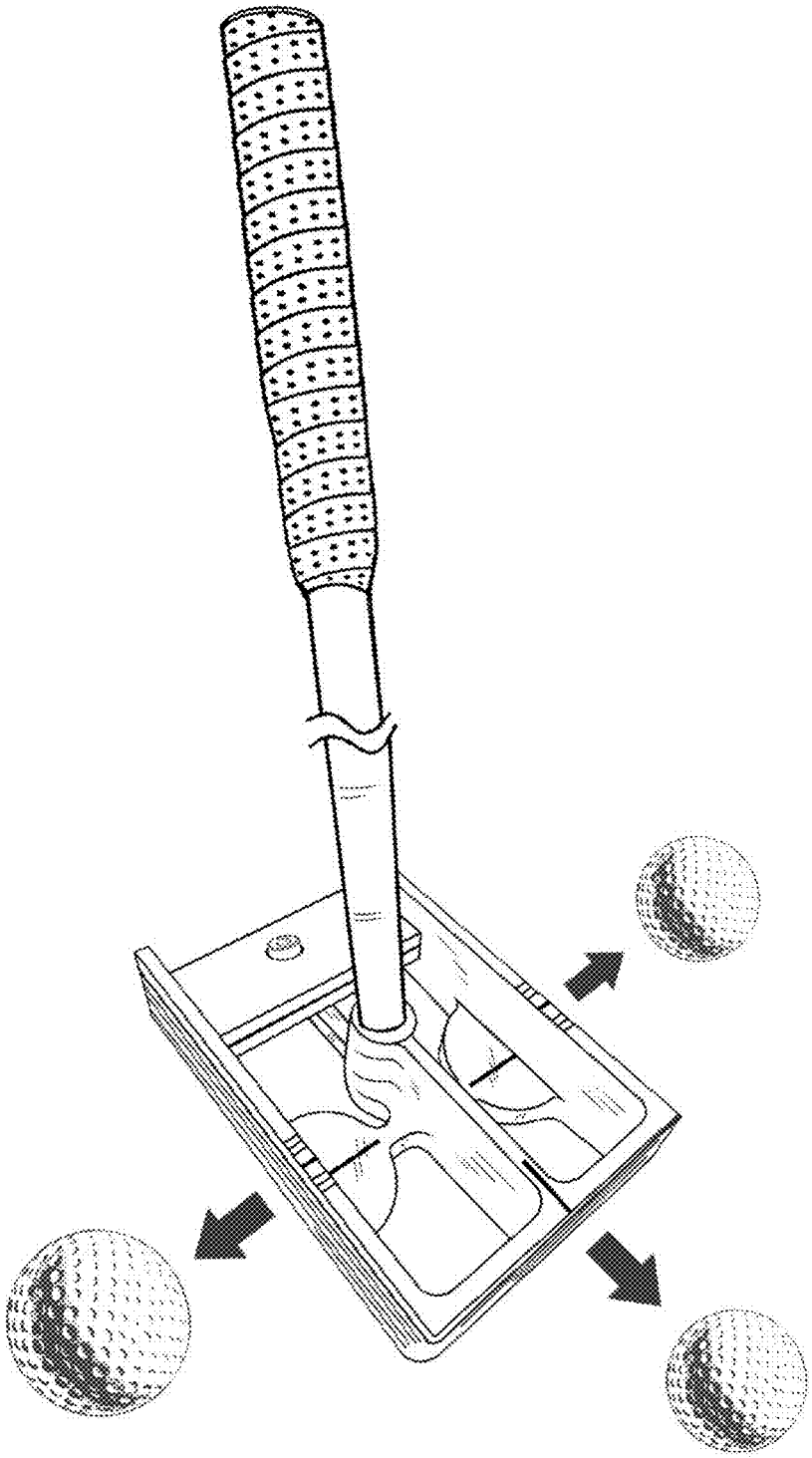
FIG. 1 is a perspective view of the putter assembly, incorporating therein the U-shaped striking plate, the frame, the shaft, the weight plates, the lines for visually aligning the putter's impact areas to the golf ball, and the indicium lines for identifying the tilt of the shaft, in accordance with an exemplary embodiment of the present invention.
Figure 9:
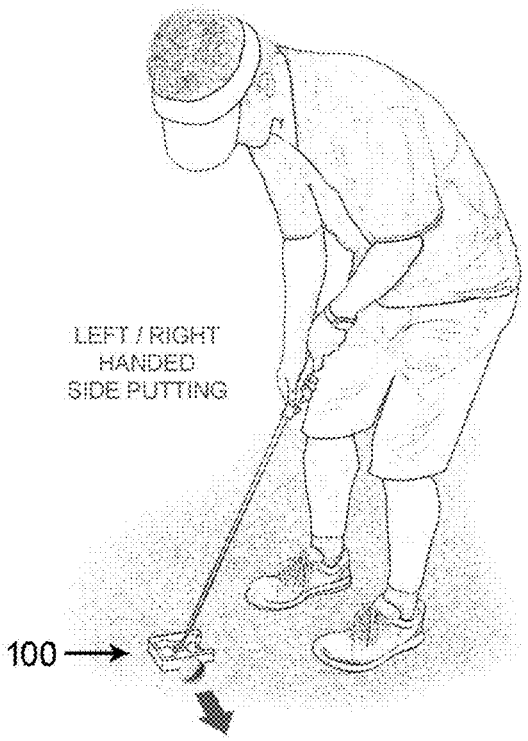
FIG. 9 is a drawing of an individual utilizing the putter assembly, using the right side putting method, wherein an annotation indicates that said putting method is applicable to both the left and the right side putting, in accordance with an exemplary embodiment of the present invention.
Figure 10:
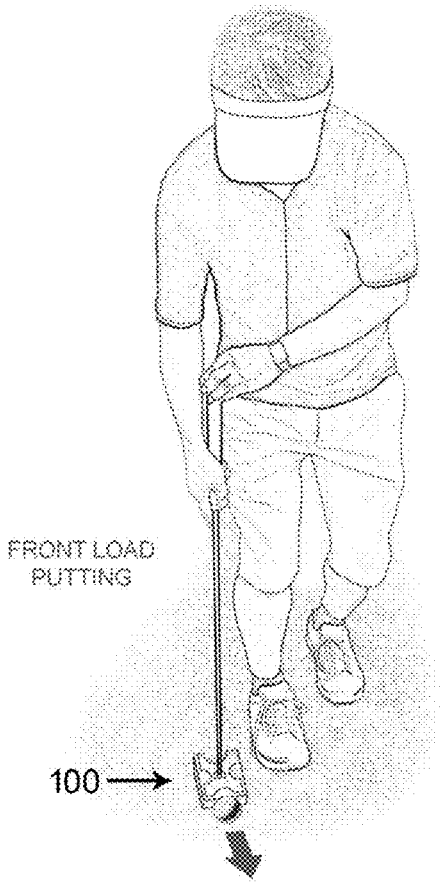
FIG. 10 is a drawing of an individual utilizing the putter assembly, using the front loaded putting method, in accordance with an exemplary embodiment of the present invention.

Shown in FIG. 1, the present invention discloses a putter assembly 100. When fully assembled, the putter 100 allows an individual using said putter 100 (the "player") to strike a golf ball 200 with either one of the three available striking surfaces 111, 113, 115. Said choice of striking surfaces allows the player to utilize the front load putting method (shown in FIG. 10), and in alternative, the left side putting method or the right handed side putting method (shown in FIG. 9).

Figure 2:
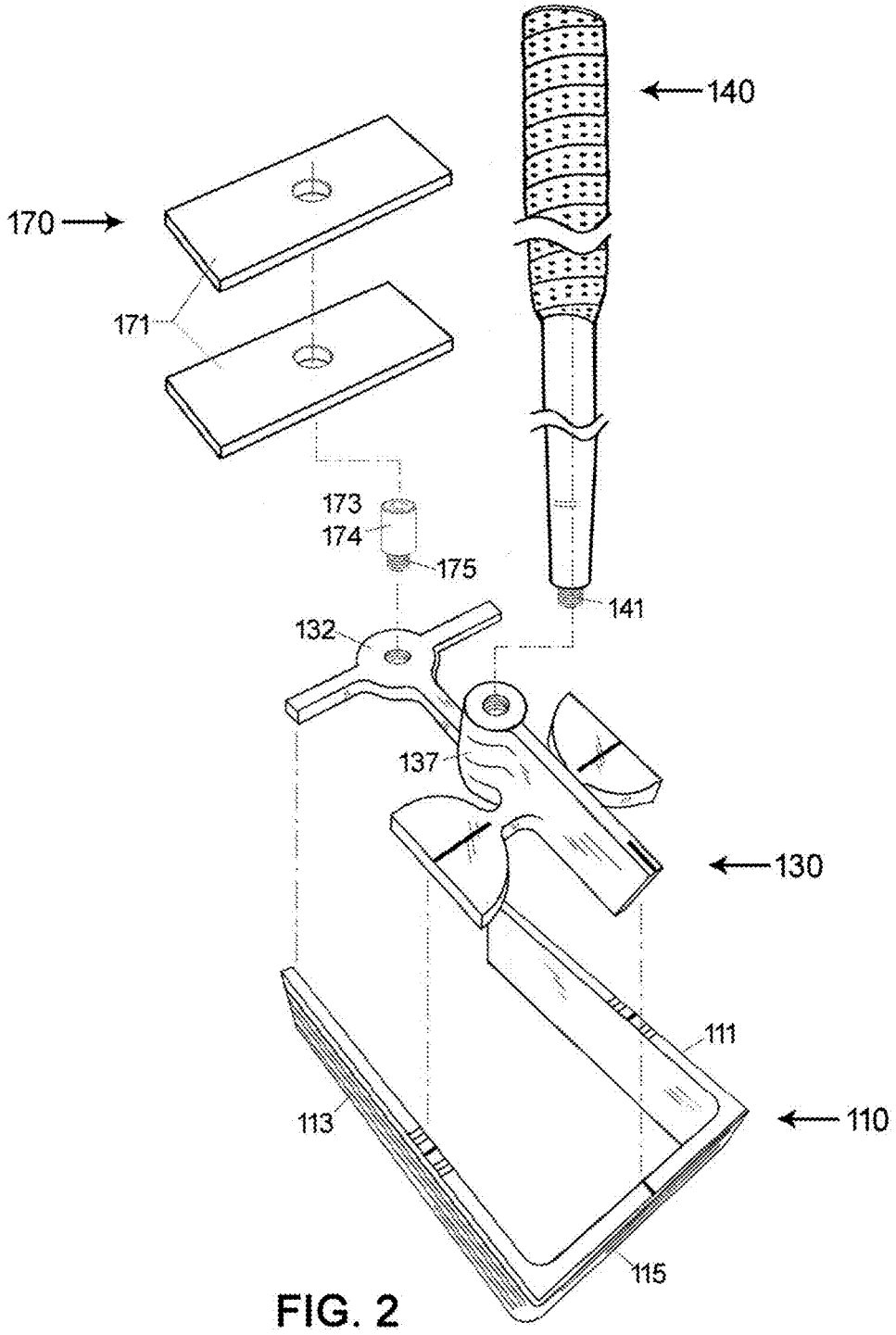
FIG. 2 is an exploded view of the putter assembly, showing the U-shaped striking plate, the frame, the shaft, the bolt, two weight plates, the lines for visually aligning the putter's impact areas to the golf ball, and the indicium lines for identifying the tilt of the shaft, in accordance with an exemplary embodiment of the present invention.

As shown in FIG. 2, the putter assembly 100 comprises of four primary components: (1) U-shaped striking plate 110; (2) the frame 130; (3) the shaft 140; (4) and the weight system.

Figure 3:
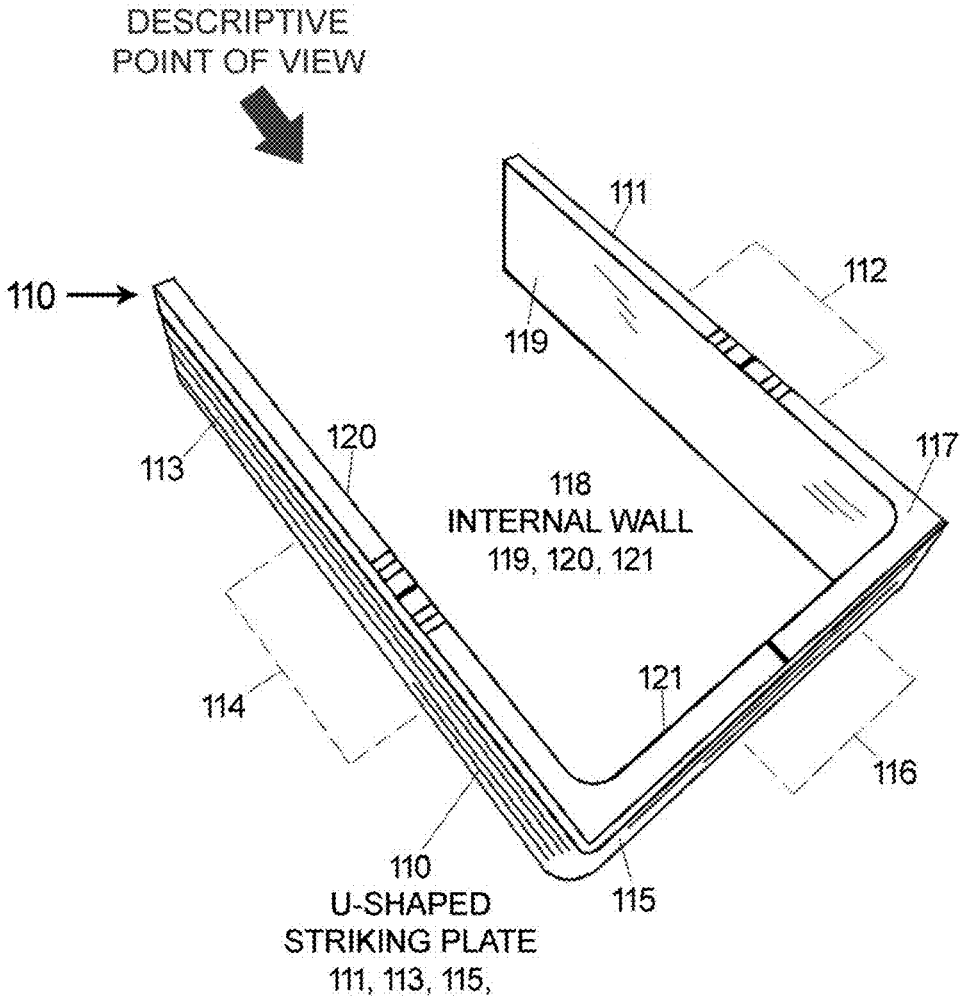
FIG. 3 is a perspective view of the striking plate, showing the descriptive point of view (the view used to determine the left, the right, the back and the front side) exposing the following components thereof: the right striking surface, the right impact area, the top surface, the front striking surface, the front impact area, the left internal surface, the left and the right indicium lines for identifying the tilt of the shaft, in accordance with an exemplary embodiment of the present invention.

The striking plate's 110 external surface, shown in FIG. 3, is subdivided into three striking surfaces: (1) the left striking surface 111; (2) the right striking surface 113; (3) the front striking surface 115. Wherein each of said striking surfaces contains an impact area. Said impact area is a section which should be utilized for striking the golf ball to enable a directionally-controlled movement of the ball. The impact areas include: (1) the left striking impact area 112; (2) the right striking impact area 114; (3) the front striking impact area 116, as shown in FIG. 3.

The striking plate 110 also comprises of the top surface 117, used for display of putter alignment features, and the internal wall 118. The internal wall comprises of three sections: (1) left internal section 119; (2) the right internal section 120; (3) front internal section 121.

Figure 4:
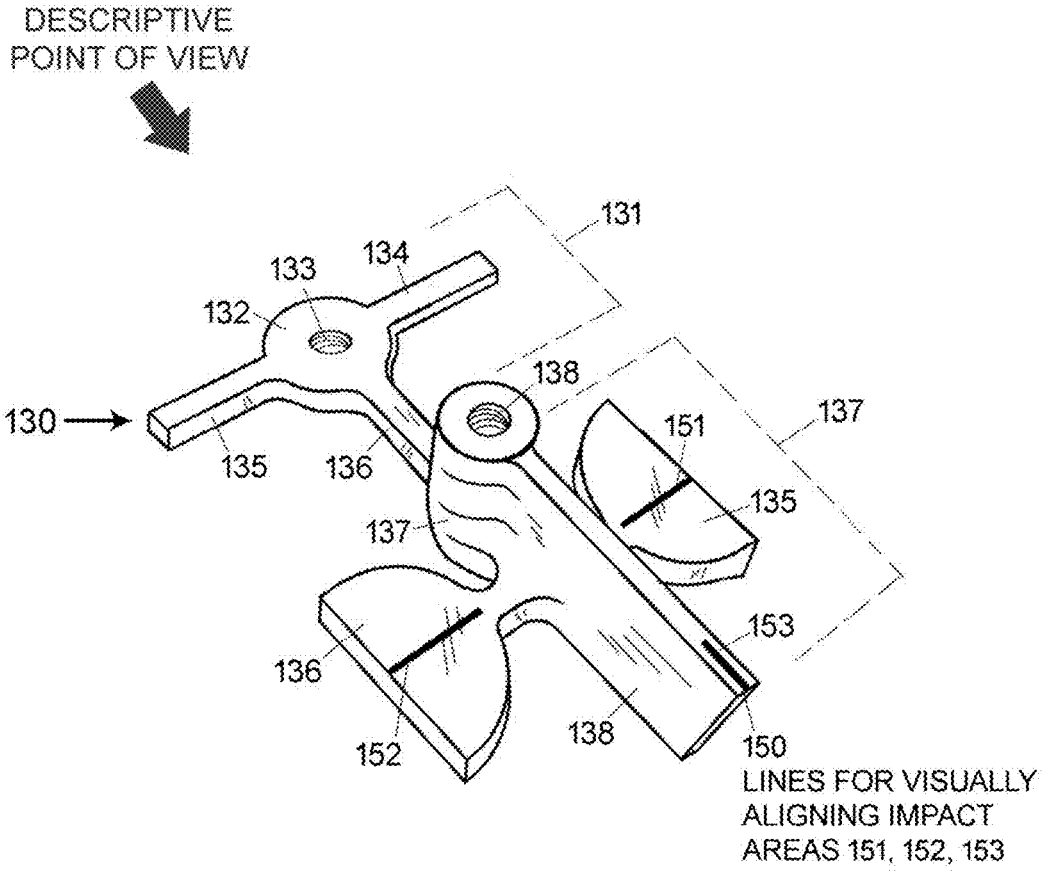
FIG. 4 is a perspective view of the frame, showing the frame's descriptive point of view, exposing the back connecting member and the front connecting member, the lines used for aligning impact areas, and the hosel, used for attaching thereto the shaft, in accordance with an exemplary embodiment of the present invention.

The second primary component of the putter assembly 100 is the frame 130. As shown in FIG. 4, the frame 130, comprises of the hosel 137 for holding the shaft 140. Said hosel 137 is generally tubular in shape, and is centrally located between the left 119 and the right 120 surface of the internal wall 118. The frame 130 also comprises and a plurality of connecting members, for connecting said hosel 137 to the internal wall 118 of the striking plate 110.

The frame 130 is subdivided into two members: (1) the back connecting member 131; (2) the front connecting member 137.

The back connecting member 131, is a T-shaped component, which is further subdivided into four sub-components: (1) the back disc 132 (circular in shape, having a top surface with a threaded hole 133 therein for stacking of weight plates 171 thereon); (2) the left arm (elongated and generally rectangular in shape, for connecting the back disc 132 to the left internal surface 119 of the striking plate 110; (3) the right arm 135 (elongated and generally rectangular in shape, for connecting the back disc 132 to the right internal surface 120 of the striking plate 110; (4) the middle arm 136 (elongated and generally rectangular in shape, perpendicular to the left 134 and the right 135 arm of the back connecting member 131, for connecting said back disc 132 to the hosel 137), as shown in FIG. 5.

Figure 5:
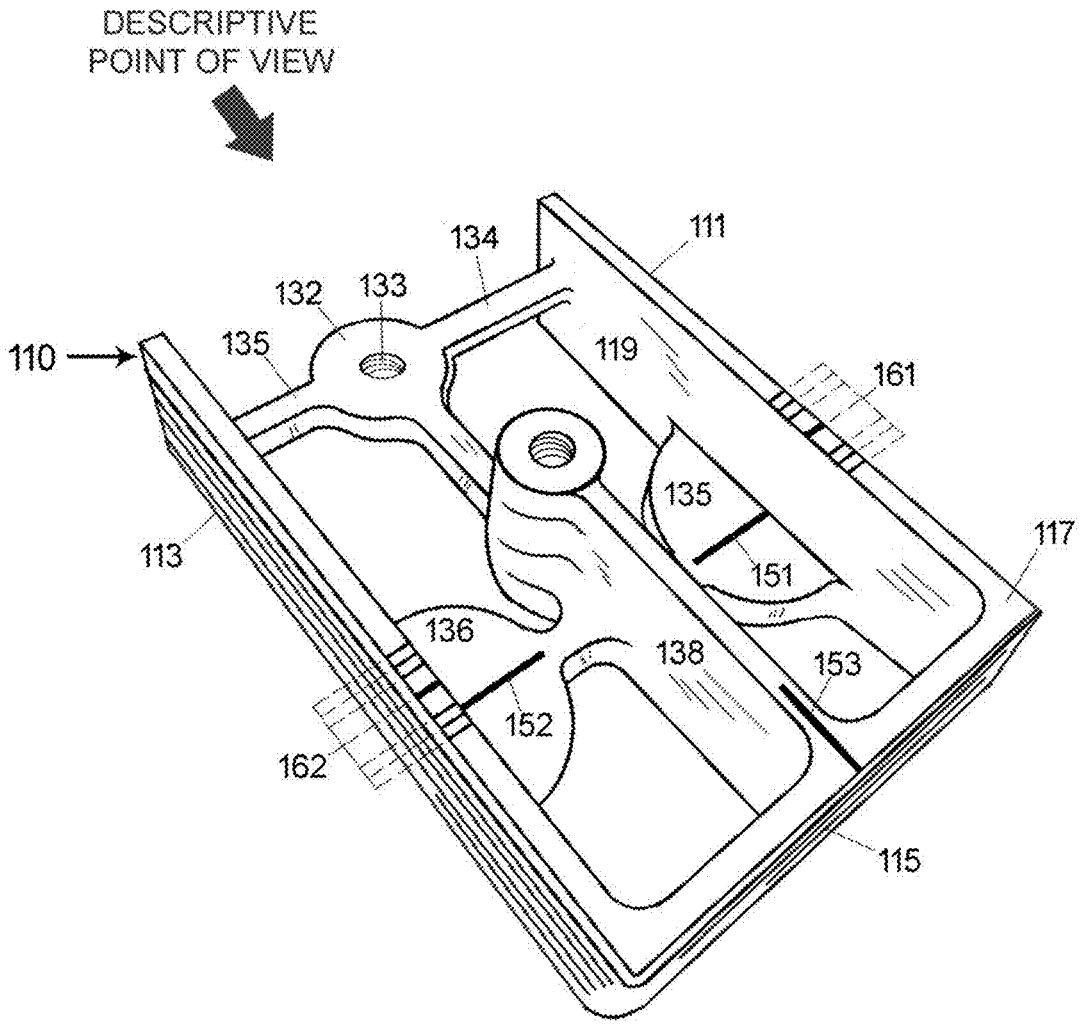
FIG. 5 is a perspective view of the striking plate and attached thereto frame, exposing the striking plate's front and right surfaces, the frame's front and back connecting members, the hosel, the lines used for aligning impact areas, and the indicium lines for identifying the tilt of the shaft, in accordance with an exemplary embodiment of the present invention.

The front connecting member 137, also shown in FIGS. 4 and 5, is subdivided into four sub-components: (1) the hosel 137 (generally tubular in shape, centrally located between the left 119 and the right 120 surface of the internal wall 118, having a threaded hole 138 on its top surface, for holding the shaft 140); (2) the a middle arm 138 (elongated and generally rectangular in shape, for connecting said hosel 137 to the front internal surface 131 of the striking plate 110); (3) the left disc 135 (semicircular in shape for connecting said middle arm 138 of the front connecting member 137 to the left internal surface 119 of the striking plate 110; (4) the right disc 136 (also semicircular in shape for connecting said middle arm 138 of the front connecting member 137 to the right internal surface 120 of the striking plate 110.

The frame 130 may be attached to the striking plate 110 by using a multitude of methods, including but not limited to usage of adhesive, mechanical screws, soldering systems, welding processes, or contraction of both components (the striking plate 110 and the frame 130) from a single block of material, such as titanium, iron, steel, aluminum, or high impact plastics.

The third primary component of the putter assembly 100 is the shaft 140. The shaft 140 comprises of a tubular pole, a handle, and a threaded end 141, (used for connecting said shaft 140 to the hosel 137 via the hosel's threaded hole 138). The shaft 140 allows the player to control the movement of the putter, making it possible to hit the golf ball in the desired direction.

Figure 6:
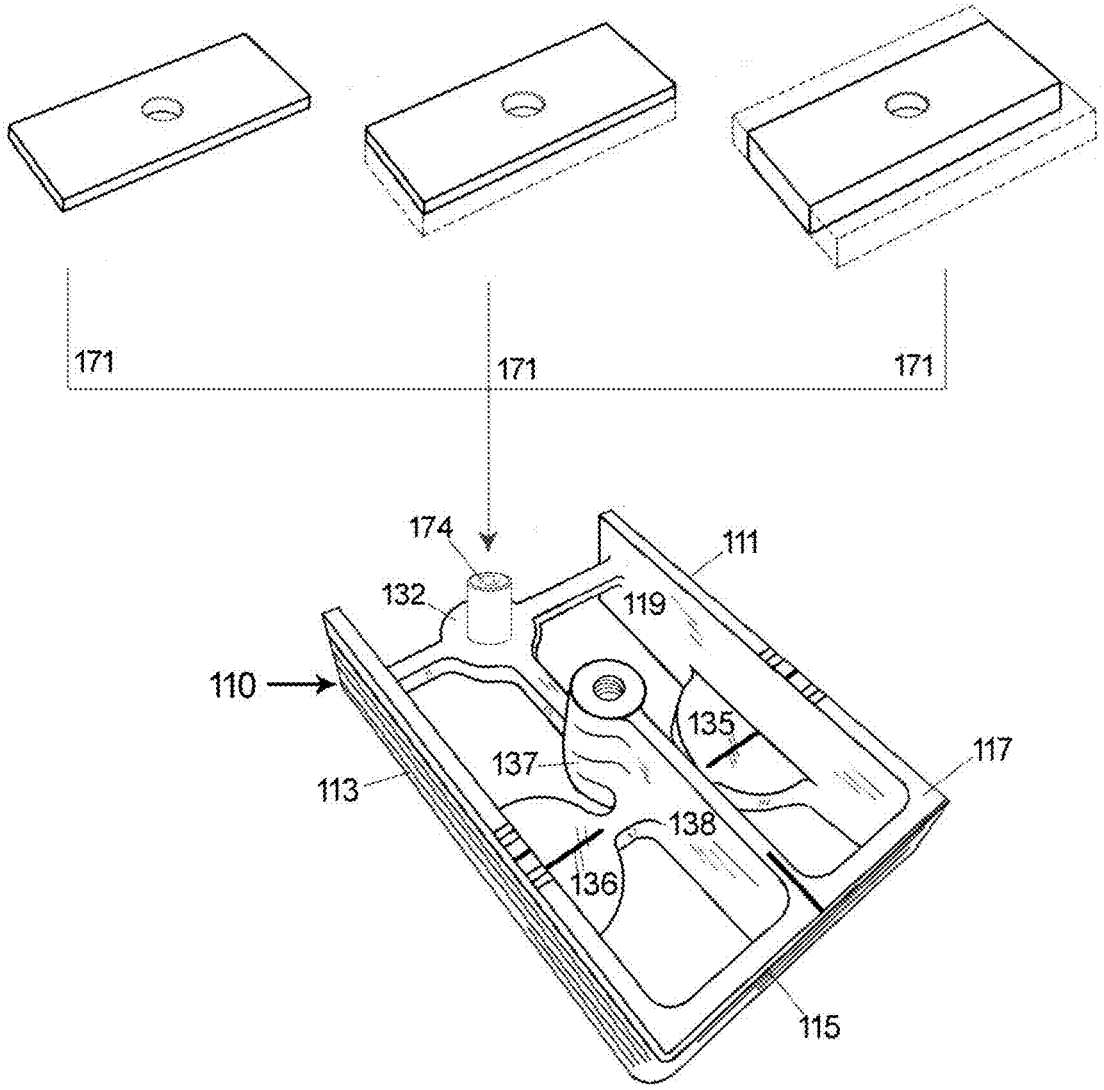
FIG. 6 is a perspective view of the striking plate and attached thereto frame, with three weight plates, shown in varying sizes, including the bolt, attached to the back disk of the back connecting member, for stacking thereon of said weight plates, in accordance with an exemplary embodiment of the present invention.

The fourth primary component of the putter assembly 100 is the weight system 170. This system proves means for adding weight to the frame 130, shown in FIG. 6. This system comprises of two components: (1) the plurality of weight plates 171 (rectangular in shape, with a centrally located clearance hole 172 for placing said weight plates onto a bolt so that movement of said plate can be restricted); (2) the bolt 173 (having an elongated head 174 designed to slideably fit into said clearance hole 172 of the weight plate 171, a threaded end 175 for inserting said bolt 173 into the threaded hole of the back disc 133 positioned so that said weight plate 171 can be sandwiched between the left 119 and the right 120 internal surface of the striking plate 110, thereby preventing the plate's horizontal and vertical movement.

The putter assembly 100 also incorporates the putter alignment features, designed to help the player improve his/her shot accuracy. Said features include: (1) alignment lines 150 for visually aligning the impact areas of the striking plates; (2) indicium lines 160, for identifying the tilt of the shaft, being held by the player.

Figure 7:
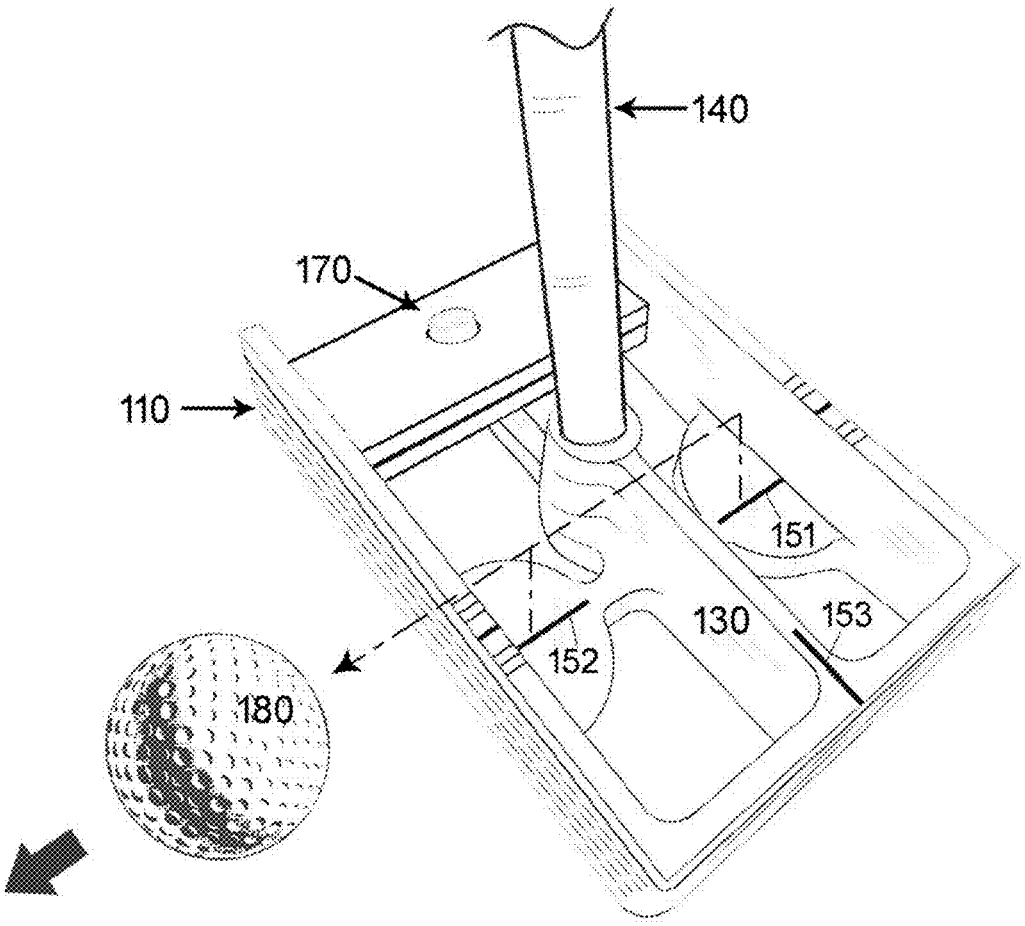
FIG. 7 is a perspective view of the putter assembly, comprising of the U-shaped striking plate, the frame, the shaft, the indicium lines for identifying the tilt of the shaft, forcing on the line used for aligning the right impact area of the striking plate, in accordance with an exemplary embodiment of the present invention.

The alignment lines 150 include the left 150, the right 152 and the vertical line 153, shown in FIGS. 4, 5, and 7.

The left horizontal line 151, disposed on the left disc 135, perpendicular to the left internal surface, for aligning the ball 200 strikes made with the left striking surface 111.

The right horizontal line 152, disposed on the right disc 136, perpendicular to the right internal surface 120, for aligning the ball 200 strikes made with the right striking surface 113.

The vertical line 153, disposed on the top surface of the frame's middle arm 138, perpendicular to the front internal surface 121, for aligning ball strikes made with the front striking surface 115.

The indicium lines 160 are subdivided into the left 161 and the right indicium 162 lines, as shown in FIG. 5.

The left indicium lines 161 are used for identifying the tilt of the shaft 140. The lines 161 are disposed on the top surface 117 of the left striking surface 111, spaced at predetermined intervals, so that changes in alignment between said left indicium lines and the left horizontal line 151, may indicate to the player using said putter, a measurable change in the tilt of the shaft 140 (reference FIG. 8).

Identically to the left indicium lines 161, the right indicium lines 162 are used for identifying the tilt of the shaft 140. The right indicium lines 162, disposed on the top surface 117 of the right striking surface 113, spaced at predetermined intervals, so that changes in alignment between said right indicium lines 162 and the right horizontal line 151, may indicate to the player using the putter 100, a measurable change in the tilt of the shaft 140.

Figure 8:
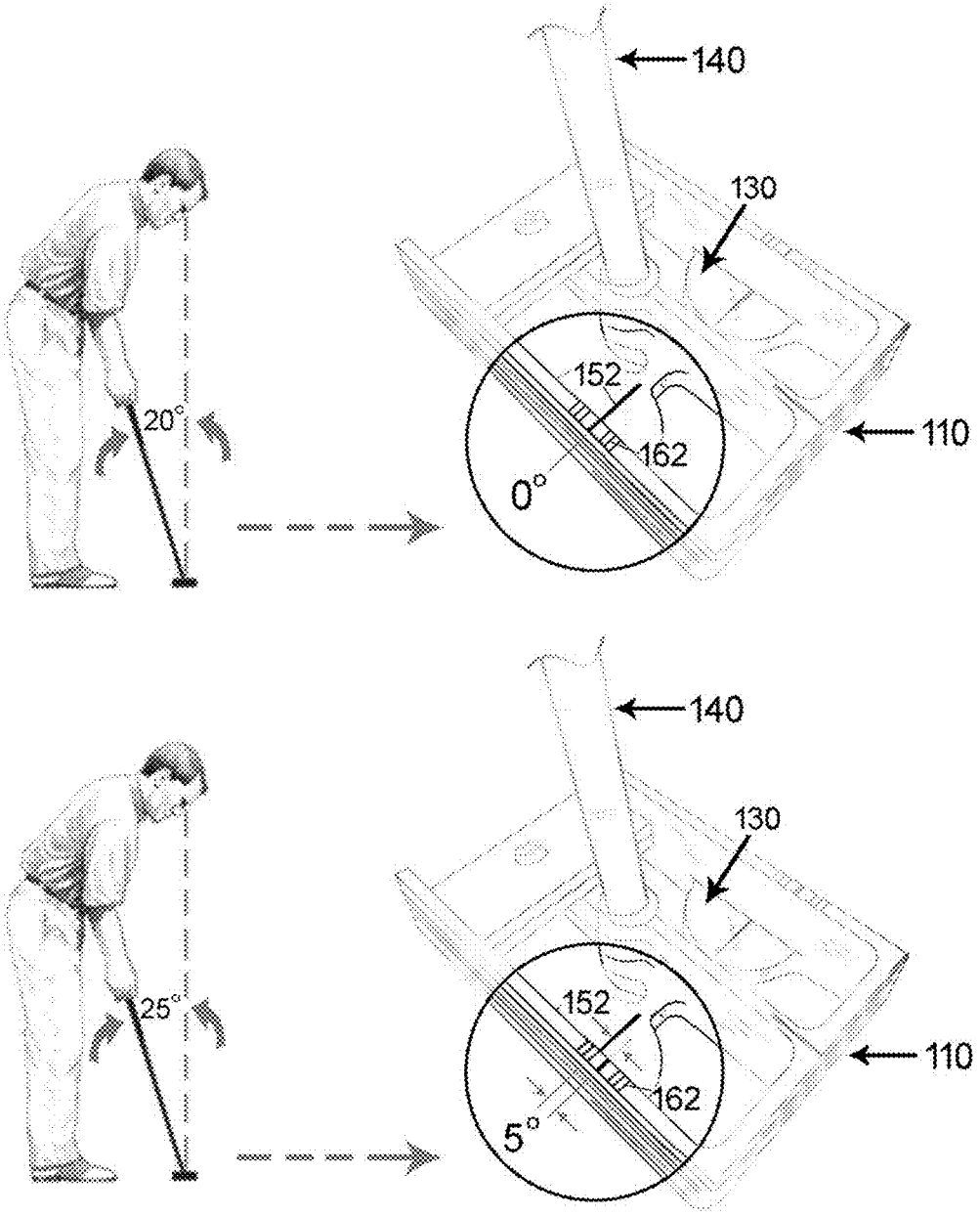
FIG. 8 shows two drawings of an individual using the putter assembly, and said individual's corresponding point of view of the right indicium lines, used for identifying the tilt of the putter's shaft, indicating that a small change in the alignment between said indicium lines and the right horizontal line, may be equivalent to a five degree change in the shaft's tilt, in accordance with an exemplary embodiment of the present invention.

FIG. 8 shows two drawings of a player using the putter assembly 100, and said player's corresponding point of view of the right indicium lines 162, used for identifying the tilt of the putter's shaft 140. The drawing indicates that a small change in the alignment between said indicium lines 162 and the right horizontal line 152, may be equivalent to a five degree change in the shaft's 140 tilt.

What is claimed is:

1. A golf putter with three ball striking surfaces, comprising:

A) a U-shaped striking plate having
- a) a left striking surface,
- b) a right striking surface,
- c) a front striking surface,
- d) a top surface,
- e) an internal wall having
  - i) a left internal surface,
  - ii) a right internal surface,
  - iii) a front internal surface, B) a frame having
- a) a hosel for holding a shaft, generally tubular in shape, centrally located between the left and the right surface of the internal wall,
- b) a plurality of connecting members for connecting said hosel to the internal wall of the striking plate;

C) a shaft fixedly connected to said hosel;

D) wherein said connecting members include
- a) a back connecting member, T-shaped, having
  - i) a back disc, circular in shape, having a top surface with a threaded hole therein for stacking of weight plates thereon,
  - ii) a left arm, elongated and generally rectangular in shape, for connecting the back disc to the left internal surface of the striking plate,
  - iii) a right arm, elongated and generally rectangular in shape, for connecting the back disc to the right internal surface of the striking plate,
  - iv) a middle arm, elongated and generally rectangular in shape, perpendicular to the left and the right arm of the back connecting member, for connecting said back disc to the hosel;
- b) a front connecting member, having
  - i) a middle arm, elongated and generally rectangular in shape, for connecting said hosel to the front internal surface of the striking plate,
  - ii) a left disc, semicircular in shape for connecting said middle arm of the front connecting member to the left internal surface of the striking plate,
  - iii) a right disc, semicircular in shape for connecting said middle arm of the front connecting member to the right internal surface of the striking plate;

E) wherein the left striking surface further comprises of an impact area for hitting the golf ball;

F) wherein the right striking surface further comprises of an impact area for hitting the golf ball;

G) wherein the front striking surface further comprises of an impact area for hitting the golf ball;

H) a means for releasably adding weight to said frame; and

I) wherein the means for releasably adding weight to said frame is via
- a) a plurality of weight plates, of predetermined size and weight, with each of said plates having a clearance hole, a short end, and a long end, wherein said long end is slideably sandwiched between the left and the right internal surface to prevent the plate's horizontal movement,
- b) a bolt, having a threaded end for insertion thereof into the threaded hole of the back disc of the back connecting member, and an elongated head, made to slidibly fit inside the weight plate's clearance hole to retain in place a multitude of said weight plates and to prevent said plate's vertical movement.

2. A golf putter with three ball striking surfaces, comprising:

A) a U-shaped striking plate having
- a) a left striking surface,
- b) a right striking surface,
- c) a front striking surface,
- d) a top surface,
- e) an internal wall having
  - i) a left internal surface,
  - ii) a right internal surface,
  - iii) a front internal surface, B) a frame having
  a) a hosel for holding a shaft, generally tubular in shape, centrally located between the left and the right surface of the internal wall,
  b) a plurality of connecting members for connecting said hosel to the internal wall of the striking plate;
C) a shaft fixedly connected to said hosel;
D) wherein said connecting members include
  a) a back connecting member, T-shaped, having
    i) a back disc, circular in shape, having a top surface with a threaded hole therein for stacking of weight plates thereon,
    ii) a left arm, elongated and generally rectangular in shape, for connecting the back disc to the left internal surface of the striking plate,
    iii) a right arm, elongated and generally rectangular in shape, for connecting the back disc to the right internal surface of the striking plate,
    iv) a middle arm, elongated and generally rectangular in shape, perpendicular to the left and the right arm of the back connecting member, for connecting said back disc to the hosel;
  b) a front connecting member, having
    i) a middle arm, elongated and generally rectangular in shape, for connecting said hosel to the front internal surface of the striking plate,
    ii) a left disc, semicircular in shape for connecting said middle arm of the front connecting member to the left internal surface of the striking plate,
    iii) a right disc, semicircular in shape for connecting said middle arm of the front connecting member to the right internal surface of the striking plate;
E) wherein the left striking surface further comprises of an impact area for hitting the golf ball;
F) wherein the right striking surface further comprises of an impact area for hitting the golf ball;
G) wherein the front striking surface further comprises of an impact area for hitting the golf ball;
H) a means for releasably adding weight to said frame;
I) wherein the means for releasably adding weight to said frame is via
  a) a plurality of weight plates, of predetermined size and weight, with each of said plates having a clearance hole, a short end, and a long end, said long end is slideably sandwiched between the left and the right internal surface to prevent the plate's horizontal movement,
  b) a bolt, having a threaded end for insertion thereof into the threaded hole of the back disc of the back connecting member, and an elongated head, made to slidibly fit inside the weight plate's clearance hole, made to retain in place a multitude of said weight plates and to prevent said plate's vertical movement;
J) a means for visually identifying the tilt of the shaft; and
K) wherein the means for visually identifying the tilt of the shaft is via
  a) a plurality of left indicium lines, disposed on the top surface of the left striking surface, spaced at predetermined intervals, so that changes in alignment between said left indicium lines and the left horizontal line, may indicate to the person using said putter, a measurable change in the tilt of the shaft,
  b) a plurality of right indicium lines, disposed on the top surface of the right striking surface, spaced at predetermined intervals, so that changes in alignment between said right indicium lines and the right horizontal line, may indicate to the person using said putter, a measurable change in the tilt of the shaft.

3. A golf putter with three ball striking surfaces, comprising:
A) a U-shaped striking plate having a left striking surface, a right striking surface, a front striking surface, a top surface, an internal wall having a left internal surface, a right internal surface, a front internal surface;
B) a frame having a back and a front connecting member
  a) said front connecting member having a hosel for holding a shaft, a middle arm for connecting said hosel to the front internal surface of the striking plate, a left disc for connecting the middle arm to the left internal surface of the striking, a right disc for connecting the middle arm to the right internal surface of the striking,
  b) said back connecting member having a back disc with a centered threaded hole for stacking of weight plates thereon, a middle arm for connecting the hosel to the back disc, a left arm for connecting the back disc to the left internal surface of the striking plate, a right arm for connecting the back disc to the right internal surface of the striking plate;
C) a shaft fixedly connected to said hosel;
D) alignment lines for aligning the striking plates to a golf ball including
  a) a left horizontal line, disposed on the left disc, perpendicular to the left internal surface, for aligning ball strikes made with the left striking surface,
  b) a right horizontal line, disposed on the right disc, perpendicular to the right internal surface, for aligning ball strikes made with the right striking surface,
  c) a vertical line, disposed on the top surface of the frame's middle arm, perpendicular to the front internal surface, for aligning ball strikes made with the front striking surface;
E) a plurality of left indicium lines for identifying the tilt of the shaft including
  a) a plurality of left indicium lines, disposed on the top surface of the left striking surface, spaced at predetermined intervals, so that changes in alignment between said left indicium lines and the left horizontal line, may indicate to the person using said putter, a measurable change in the tilt of the shaft,
  b) a plurality of right indicium lines, disposed on the top surface of the right striking surface, spaced at predetermined intervals, so that changes in alignment between said right indicium lines and the right horizontal line, may indicate to the person using said putter, a measurable change in the tilt of the shaft; and
F) a plurality of weight plates, rectangular in shape, for adding weight to the frame, having
  a) a centrally located clearance hole for placing said weight plates onto a bolt so that movement of said plate can be restricted,
  b) a bolt having
    i) an elongated head designed to slideably fit into said clearance hole of the weight plate,
    ii) a threaded end for inserting thereof into the threaded hole of the back disc positioned so that said weight plate can be sandwiched between the left and the right internal surface of the striking plate, thereby preventing the plate's horizontal and vertical movement.

* * * * *